US011588245B2

(12) United States Patent
Wei

(10) Patent No.: US 11,588,245 B2
(45) Date of Patent: Feb. 21, 2023

(54) MOBILE DEVICE

(71) Applicant: Wistron NeWeb Corp., Hsinchu (TW)

(72) Inventor: Shih-Chiang Wei, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 785 days.

(21) Appl. No.: 16/655,926

(22) Filed: Oct. 17, 2019

(65) Prior Publication Data

US 2020/0168993 A1 May 28, 2020

(30) Foreign Application Priority Data

Nov. 28, 2018 (TW) ..... 107142393

(51) Int. Cl.

| | |
|---|---|
| ***H01Q 5/392*** | (2015.01) |
| ***H01Q 1/24*** | (2006.01) |
| ***H01Q 1/38*** | (2006.01) |
| ***H01Q 1/48*** | (2006.01) |
| ***H01Q 5/15*** | (2015.01) |
| ***H01Q 13/10*** | (2006.01) |

(52) U.S. Cl.

CPC ..... *H01Q 5/392* (2015.01); *H01Q 1/24* (2013.01); *H01Q 1/243* (2013.01); *H01Q 1/38* (2013.01); *H01Q 1/48* (2013.01); *H01Q 5/15* (2015.01); *H01Q 13/10* (2013.01); *H01Q 13/106* (2013.01)

(58) Field of Classification Search

CPC ..... H01Q 1/243; H01Q 1/48; H01Q 1/38; H01Q 5/392; H01Q 5/15; H01Q 13/106; H01Q 1/24; H01Q 13/10

USPC ..... 343/700 MS

See application file for complete search history.

(56) References Cited

U.S. PATENT DOCUMENTS

| | | | | |
|---|---|---|---|---|
| 9,099,766 | B2 | 8/2015 | Chan et al. | |
| 10,056,696 | B2 | 8/2018 | Tseng et al. | |
| 2009/0153407 | A1 | 6/2009 | Zhang et al. | |
| 2010/0207835 | A1* | 8/2010 | Taura | H01Q 13/10 343/770 |

(Continued)

FOREIGN PATENT DOCUMENTS

| | | | |
|---|---|---|---|
| CN | 104617379 | A | 5/2015 |
| CN | 206076499 | U | 4/2017 |
| TW | M537316 | U | 2/2017 |

*Primary Examiner* — Hai V Tran

(74) *Attorney, Agent, or Firm* — McClure, Qualey & Rodack, LLP

(57) ABSTRACT

A mobile device includes a metal mechanism element, a dielectric substrate, a ground plane, a parasitic radiation element, and a feeding radiation element. A connection end of the parasitic radiation element is coupled to the ground plane. The parasitic radiation element includes a first widening portion, which is positioned at a bend of the parasitic radiation element. The parasitic radiation element has a vertical projection on the metal mechanism element. The vertical projection at least partially overlaps a first closed end of the slot. The feeding radiation element is disposed between the parasitic radiation element and the ground plane. The dielectric substrate is adjacent to the metal mechanism element. The parasitic radiation element and the feeding radiation element are disposed on the dielectric substrate. An antenna structure is formed by the parasitic radiation element, the feeding radiation element, and the slot of the metal mechanism element.

19 Claims, 7 Drawing Sheets

(56) References Cited

U.S. PATENT DOCUMENTS

| | | | | |
|---|---|---|---|---|
| 2015/0123874 | A1* | 5/2015 | Chan | H01Q 5/30<br>343/905 |
| 2018/0183137 | A1* | 6/2018 | Tsai | H01Q 5/335 |
| 2019/0006764 | A1* | 1/2019 | Yen | H01Q 1/38 |
| 2019/0044216 | A1* | 2/2019 | Lu | H01Q 1/38 |
| 2019/0198975 | A1* | 6/2019 | Chen | H01Q 9/42 |

* cited by examiner

MOBILE DEVICE

CROSS REFERENCE TO RELATED APPLICATIONS

This application claims priority of Taiwan Patent Application No. 107142393 filed on Nov. 28, 2018, the entirety of which is incorporated by reference herein.

BACKGROUND OF THE INVENTION

Field of the Invention

The disclosure generally relates to a mobile device, and more particularly, it relates to a mobile device and an antenna structure therein.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

In order to improve their appearance, designers often incorporate metal elements into mobile devices. However, these newly added metal elements tend to negatively affect the antennas used for wireless communication in mobile devices, thereby degrading the overall communication quality of the mobile devices. As a result, there is a need to propose a mobile device with a novel antenna structure, so as to overcome the problems of the prior art.

BRIEF SUMMARY OF THE INVENTION

In an exemplary embodiment, the disclosure is directed to a mobile device that includes a metal mechanism element, a ground plane, a parasitic radiation element, a feeding radiation element, and a dielectric substrate. The metal mechanism element has a slot. The slot has a first closed end and a second closed end. The parasitic radiation element has a connection end and an open end. The connection end of the parasitic radiation element is coupled to the ground plane. The parasitic radiation element includes a first widening portion. The first widening portion is positioned at a bend of the parasitic radiation element. The parasitic radiation element has a vertical projection on the metal mechanism element. The vertical projection of the parasitic radiation element at least partially overlaps the first closed end of the slot. The feeding radiation element has a feeding point. The feeding radiation element is disposed between the parasitic radiation element and the ground plane. The dielectric substrate is adjacent to the metal mechanism element. The parasitic radiation element and the feeding radiation element are disposed on the dielectric substrate. An antenna structure is formed by the parasitic radiation element, the feeding radiation element, and the slot of the metal mechanism element.

In some embodiments, the mobile device further includes a tuning radiation element and a circuit element. The tuning radiation element extends across the slot. The tuning radiation element includes a first portion and a second portion. The first portion and the second portion are respectively coupled to the metal mechanism element. The circuit element is coupled between the first portion and the second portion of the tuning radiation element.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
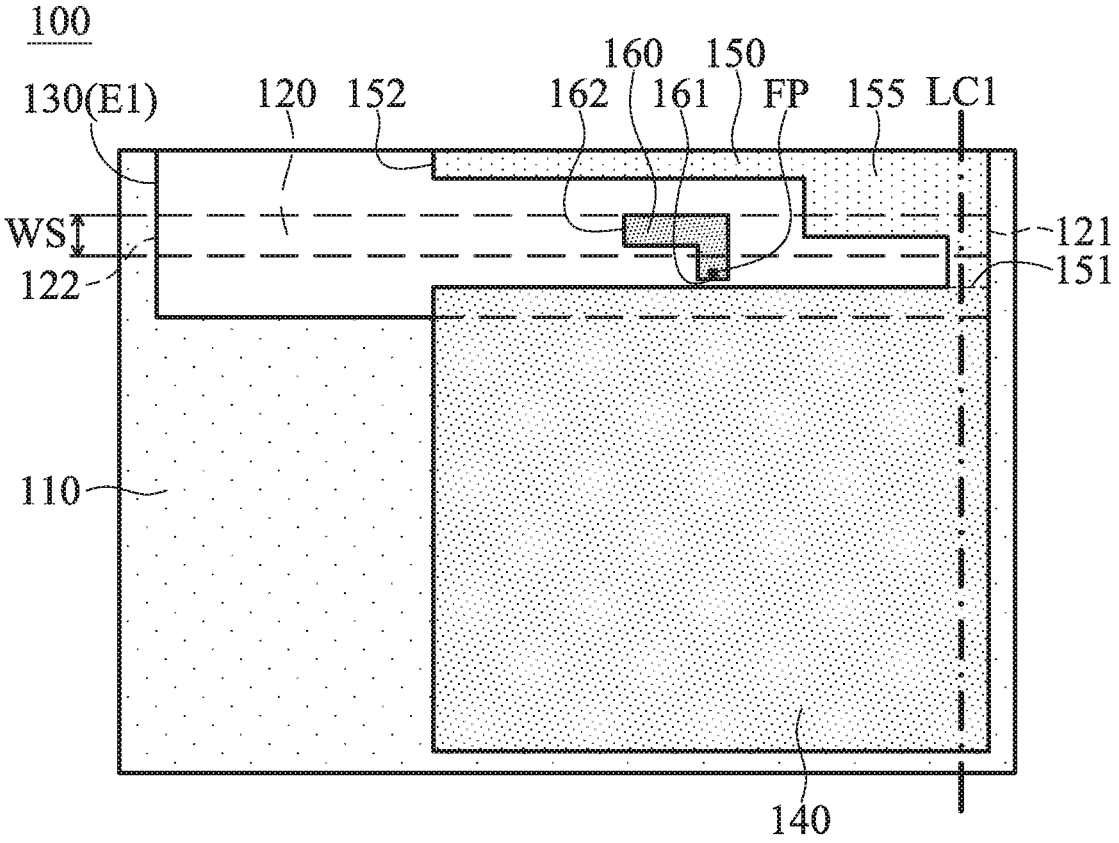
FIG. 1A is a top view of a mobile device according to an embodiment of the invention.
Figure 1B:
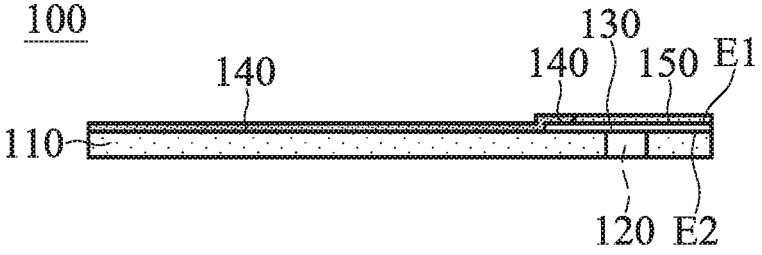
FIG. 1B is a sectional view of a mobile device according to an embodiment of the invention.

FIG. 1A is a top view of a mobile device 100 according to an embodiment of the invention. FIG. 1B is a sectional view of the mobile device 100 according to an embodiment of the invention (along a sectional line LC1 of FIG. 1A). For example, the mobile device 100 may be a smartphone, a tablet computer, or a notebook computer. Please refer to FIG. 1A and FIG. 1B together. As shown in FIG. 1A and FIG. 1B, the mobile device 100 includes a metal mechanism element 110, a dielectric substrate 130, a ground plane 140, a parasitic radiation element 150, and a feeding radiation element 160. The ground plane 140, the parasitic radiation element 150, and the feeding radiation element 160 may be made of metal materials, such as copper, silver, aluminum, iron, or their alloys.

The metal mechanism element 110 may be a metal housing of the mobile device 100. In some embodiments, the metal mechanism element 110 is a metal upper cover of a notebook computer or a metal back cover of a tablet computer, but it is not limited thereto. The metal mechanism element 110 has a slot 120. The slot 120 of the metal mechanism element 110 may substantially have a straight-line shape. Specifically, the slot 120 has a first closed end 121 and a second closed end 122 which are away from each other. The mobile device 100 may further include a non-conductive material, which fills the slot 120 of the metal mechanism element 110.

The dielectric substrate 130 may be an FR4 (Flame Retardant 4) substrate, a PCB (Printed Circuit Board), or an FCB (Flexible Circuit Board). The dielectric substrate 130 has a first surface E1 and a second surface E2 which are opposite to each other. The parasitic radiation element 150 and the feeding radiation element 160 are both disposed on the first surface E1 of the dielectric substrate 130. The second surface E2 of the dielectric substrate 130 is adjacent to the slot 120 of the metal mechanism element 110. In some embodiments, the parasitic radiation element 150 and the feeding radiation element 160 are both disposed on the second surface E2 of the dielectric substrate 130. In alternative embodiments, the parasitic radiation element 150 is disposed on the first surface E1 of the dielectric substrate 130 and the feeding radiation element 160 is disposed on the second surface E2 of the dielectric substrate 130, or the parasitic radiation element 150 is disposed on the second surface E2 of the dielectric substrate 130 and the feeding radiation element 160 is disposed on the first surface E1 of the dielectric substrate 130. It should be noted that the term "adjacent" or "close" over the disclosure means that the distance (spacing) between two corresponding elements is smaller than a predetermined distance (e.g., 5 mm or shorter), or means that the two corresponding elements directly touch each other (i.e., the aforementioned distance/spacing therebetween is reduced to 0). In some embodiments, the second surface E2 of the dielectric substrate 130 is directly attached to the metal mechanism element 110, and the dielectric substrate 130 extends across the slot 120 of the metal mechanism element 110. The ground plane 140 may be a ground copper foil, which may substantially have a stepped-shape. For example, the ground plane 140 may be coupled to the metal mechanism element 110, and the ground plane 140 may extend from the metal mechanism element 110 onto the first surface E1 of the dielectric substrate 130. In a preferred embodiment, an antenna structure is formed by the parasitic radiation element 150, the feeding radiation element 160, and the slot 120 of the metal mechanism element 110.

The parasitic radiation element 150 may substantially have a width-varying L-shape. The parasitic radiation element 150 has a connection end 151 and an open end 152. The connection end 151 of the parasitic radiation element 150 may be coupled to a corner of the ground plane 140. The parasitic radiation element 150 includes a first widening portion 155. The first widening portion 155 is positioned at a bend (e.g., the right-angle bend of the L-shape) in the parasitic radiation element 150. The first widening portion 155 of the parasitic radiation element 150 may substantially have a rectangular shape. Alternatively, the first widening portion 155 of the parasitic radiation element 150 may substantially have a triangular shape (not shown), such that the width of the first widening portion 155 is greater than the width of the other portion of the parasitic radiation element 150. The parasitic radiation element 150 has a vertical projection on the metal mechanism element 110, and the vertical projection of the parasitic radiation element 150 at least partially overlaps the first closed end 121 of the slot 120. For example, the vertical projection of the connection end 151 or the vertical projection of the first widening portion 155 may be substantially aligned with the first closed end 121 of the slot 120. According to different design requirements, the first widening portion 155 of the parasitic radiation element 150 may extend across at least a portion of the width WS of the slot 120, or may not extend across the slot 120 at all. In other words, the vertical projection of the first widening portion 155 may at least partially overlap the slot 120, or may not overlap the slot 120 at all.

The feeding radiation element 160 may substantially have an equal-width L-shape. Alternatively, the feeding radiation element 160 may substantially have a rectangular shape or a trapezoidal shape. The feeding radiation element 160 has a first end 161 and a second end 162. A feeding point FP is positioned at the first end 161 of the feeding radiation element 160. The second end 162 of the feeding radiation element 160 is an open end. For example, the feeding point FP may be coupled to a signal source (not shown), and the signal source may be an RF (Radio Frequency) module for exciting the antenna structure of the mobile device 100. The feeding radiation element 160 may be disposed in a notch region, which is defined between the parasitic radiation element 150 and the ground plane 140. The feeding radiation element 160 extends across at least a portion of the width WS of the slot 120. That is, the feeding radiation element 160 has a vertical projection on the metal mechanism element 110, and the vertical projection of the feeding radiation element 160 at least partially overlaps the slot 120.

According to practical measurements, the antenna structure of the mobile device 100 can cover a first frequency band and a second frequency band. The first frequency band may be from about 2400 MHz to about 2500 MHz, and the second frequency band may be from about 5150 MHz to about 5850 MHz. Therefore, the mobile device 100 can support at least the dual-band operations of WLAN (Wireless Local Area Networks) 2.4 GHz/5 GHz. The following embodiments will introduce a variety of configurations of the proposed mobile device and antenna structure. It should be understood that these figures and descriptions are merely exemplary, rather than limitations of the invention.

Figure 2:
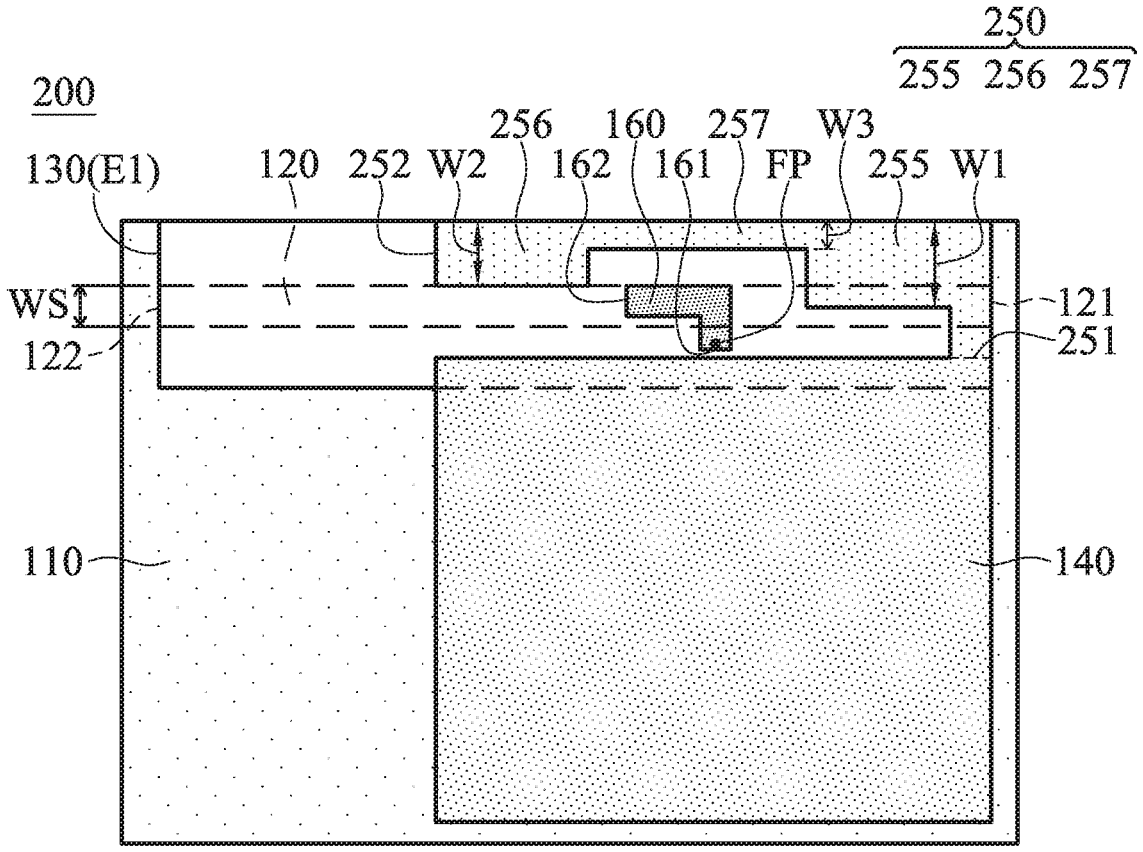
FIG. 2 is a top view of a mobile device according to an embodiment of the invention.

FIG. 2 is a top view of a mobile device 200 according to an embodiment of the invention. FIG. 2 is similar to FIG. 1A. In the embodiment of FIG. 2, a parasitic radiation element 250 of the mobile device 200 has a connection end 251 and an open end 252, and includes a first widening portion 255, a second widening portion 256, and a connection portion 257. The first widening portion 255 is disposed at a bend in the parasitic radiation element 250. The second widening portion 256 is disposed at the open end 252 of the parasitic radiation element 250. The connection portion 257 is coupled between the first widening portion 255 and the second widening portion 256. A first coupling gap GC1 is formed between the feeding radiation element 160 and the connection portion 257 of the parasitic radiation element 250. The first widening portion 255 of the parasitic radiation element 250 may substantially have a rectangular shape. The second widening portion 256 of the parasitic radiation element 250 may substantially have another rectangular shape. The connection portion 257 of the parasitic radiation element 250 may substantially have a straight-line shape. According to different design requirements, the first widening portion 255 and/or the second widening portion 256 of the parasitic radiation element 250 may extend across at least a portion of the width WS of the slot 120, or may not extend across the slot 120 at all. In other words, each of the first widening portion 255 and the second widening portion 256 has a vertical projection on the metal mechanism element 110. The vertical projection of the first widening portion 255 may at least partially overlap the slot 120, or may not overlap the slot 120 at all. The vertical projection of the second widening portion 256 may at least partially overlap the slot 120, or may not overlap the slot 120 at all. In some embodiments, the width W1 of the first widening portion 255 is greater than the width W2 of the second widening portion 256, and the width W2 of the second widening portion 256 is greater than the width W3 of the connection portion 257. In alternative embodiments, the width W1 of the first widening portion 255 is smaller than or equal to the width W2 of the second widening portion 256, and the width W1 of the first widening portion 255 is greater than the width W3 of the connection portion 257. Other features of the mobile device 200 of FIG. 2 are similar to those of the mobile device 100 of FIG. 1A and FIG. 1B. Accordingly, the two embodiments can achieve similar levels of performance.

Figure 3:
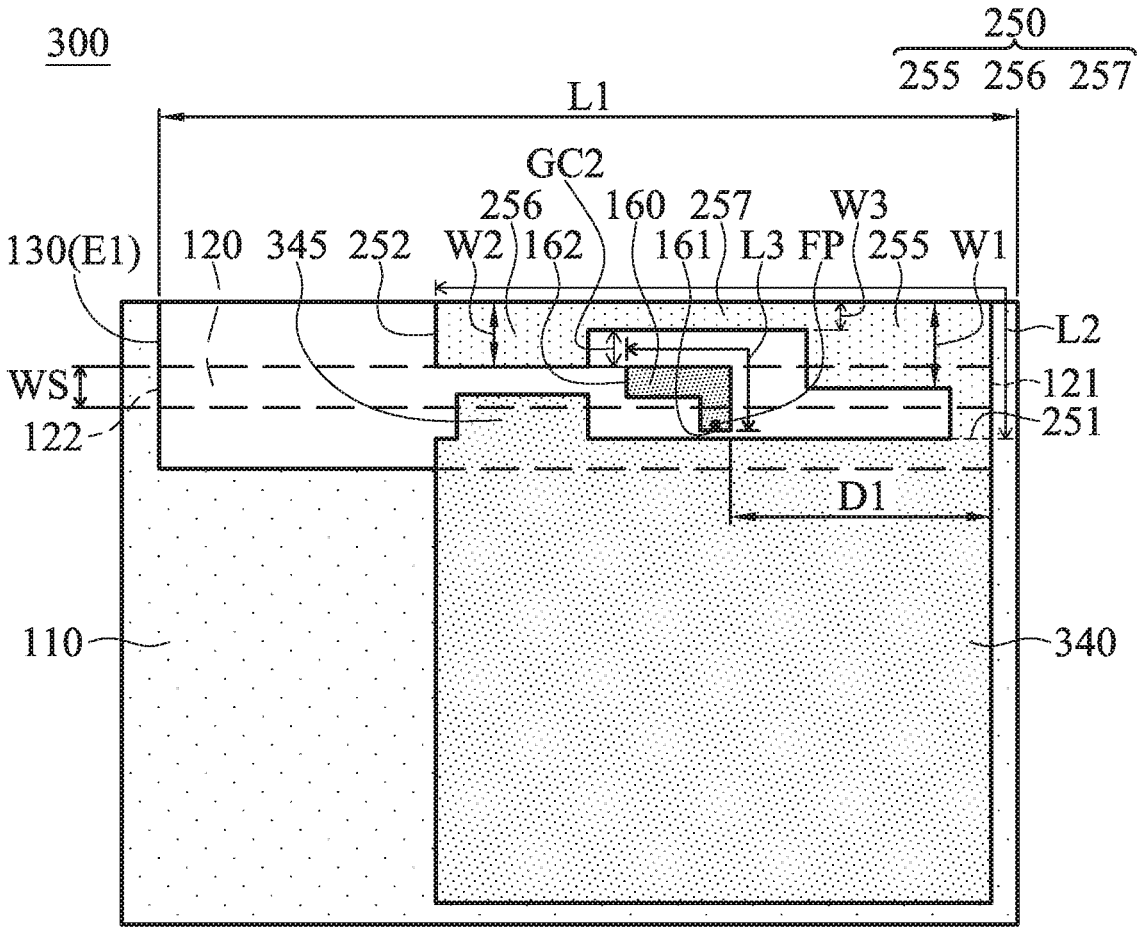
FIG. 3 is a top view of a mobile device according to an embodiment of the invention.

FIG. 3 is a top view of a mobile device 300 according to an embodiment of the invention. FIG. 3 is similar to FIG. 2. In the embodiment of FIG. 3, a ground plane 340 of the mobile device 300 further includes a protruding portion 345. The protruding portion 345 of the ground plane 340 may substantially have a rectangular shape. Alternatively, the protruding portion 345 of the ground plane 340 may substantially have an L-shape or a trapezoidal shape (not shown). The protruding portion 345 of the ground plane 340 may extend toward the second widening portion 256 of the parasitic radiation element 250. The slot 120 is positioned between the second widening portion 256 and the protruding portion 345, such that the second widening portion 256 and the protruding portion 345 are positioned at an upper side and a lower side of the slot 120, respectively. According to different design requirements, the protruding portion 345 of the ground plane 340 may extend across at least a portion of the width WS of the slot 120, or may not extend across the slot 120 at all. In other words, the protruding portion 345 has a vertical projection on the metal mechanism element 110, and the vertical projection of the protruding portion 345 may at least partially overlap the slot 120 or may not overlap the slot 120 at all. Other features of the mobile device 300 of FIG. 3 are similar to those of the mobile device 200 of FIG. 2. Accordingly, the two embodiments can achieve similar levels of performance.

Figure 4:
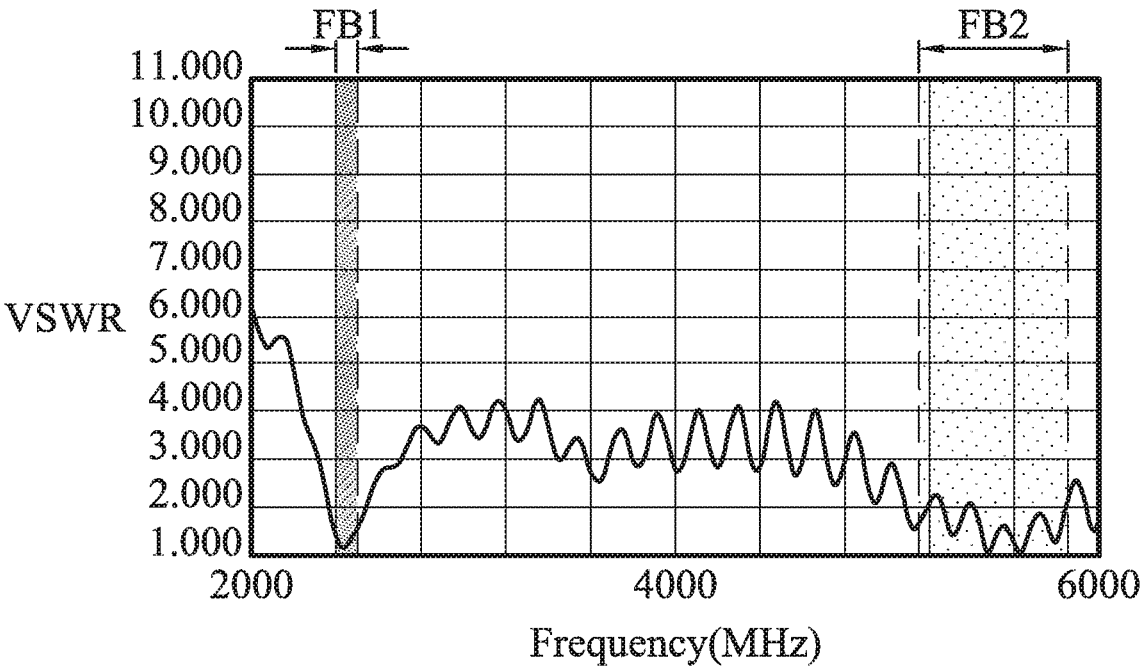
FIG. 4 is a diagram of VSWR (Voltage Standing Wave Ratio) of an antenna structure of a mobile device according to an embodiment of the invention.

FIG. 4 is a diagram of VSWR (Voltage Standing Wave Ratio) of the antenna structure of the mobile device 300 according to an embodiment of the invention. According to the measurement of FIG. 4, the antenna structure of the mobile device 300 can cover a first frequency band FB1 and a second frequency band FB2. The first frequency band FB1 may be from about 2400 MHz to about 2500 MHz. The second frequency band FB2 may be from about 5150 MHz to about 5850 MHz. Therefore, the antenna structure of the mobile device 300 can support at least the dual-band operations of WLAN (Wireless Local Area Network) 2.4 GHz/5 GHz. With respect to the antenna theory, the parasitic radiation element 250 is mainly excited to generate the first frequency band FB1. Alternatively, the parasitic radiation element 250 and the slot 120 of the metal mechanism element 110 are mainly excited to generate the first frequency band FB1. The slot 120 of the metal mechanism element 110 is mainly excited to generate the second frequency band FB2. The first widening portion 255 of the parasitic radiation element 250 is configured to fine-tune the frequency shift amount and the impedance matching of the first frequency band FB1 and the second frequency band FB2. The second widening portion 256 of the parasitic radiation element 250 is configured to fine-tune the frequency shift amount and the impedance matching of the first frequency band FB1. The protruding portion 345 of the ground plane 340 is configured to fine-tune the impedance matching of the second frequency band FB2.

In some embodiments, the element sizes of the mobile device 300 are as described as follows. The length L1 of the slot 120 (i.e., the length L1 from the first closed end 121 to the second closed end 122) may be substantially equal to 0.5 wavelength (λ/2) of the first frequency band FB1. The length L2 of the parasitic radiation element 250 (i.e., the length L2 from the connection end 251 to the open end 252) may be longer than or equal to 0.25 wavelength (λ/4) of the first frequency band FB1. The length L3 of the feeding radiation element 160 (i.e., the length L3 from the first end 161 to the second end 162) may be substantially equal to 0.25 wavelength (λ/4) of the second frequency band FB2. When the shape of the feeding radiation element 160 is changed to a T-shape or a rectangular shape, its length L3 may be correspondingly adjusted. The width of the first coupling gap GC1 may be from 0.5 mm to 5 mm. The distance D1 between the feeding radiation element 160 and the first closed end 121 of the slot 120 may be 0.25 to 0.33 times the length L1 of the slot 120. The above ranges of element sizes are calculated and obtained according to the results of many experiments, and they help to optimize the operation bandwidth and impedance matching of the antenna structure of the mobile device 300.

Figure 5:
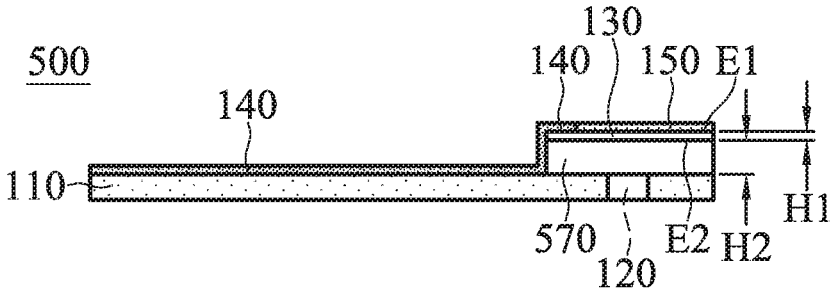
FIG. 5 is a sectional view of a mobile device according to an embodiment of the invention.

FIG. 5 is a sectional view of a mobile device 500 according to an embodiment of the invention. FIG. 5 is similar to FIG. 1B. In the embodiment of FIG. 5, the mobile device 500 further includes a thickening layer 570. Both the dielectric substrate 130 and the thickening layer 570 may be made of nonconductive materials. The thickening layer 570 is disposed between the dielectric substrate 130 and the metal mechanism element 110. For example, the thickening layer 570 may directly touch the metal mechanism element 110, and the thickening layer 570 may be configured to support the second surface E2 of the dielectric substrate 130. The dielectric constant of the thickening layer 570 may be the same as or different from the dielectric constant of the dielectric substrate 130. The height H2 of the thickening layer 570 may be greater than or equal to the height H1 of the dielectric substrate 130. For example, the height H2 of the thickening layer 570 may 1 to 10 times the height H1 of the dielectric substrate 130. According to practical measurements, the incorporation of the thickening layer 570 can increase a portion of the operation bandwidth and the radiation efficiency of the antenna structure of the mobile device 500. Other features of the mobile device 500 of FIG. 5 are similar to those of the mobile device 100 of FIG. 1A and FIG. 1B. Accordingly, the two embodiments can achieve similar levels of performance.

Figure 6:
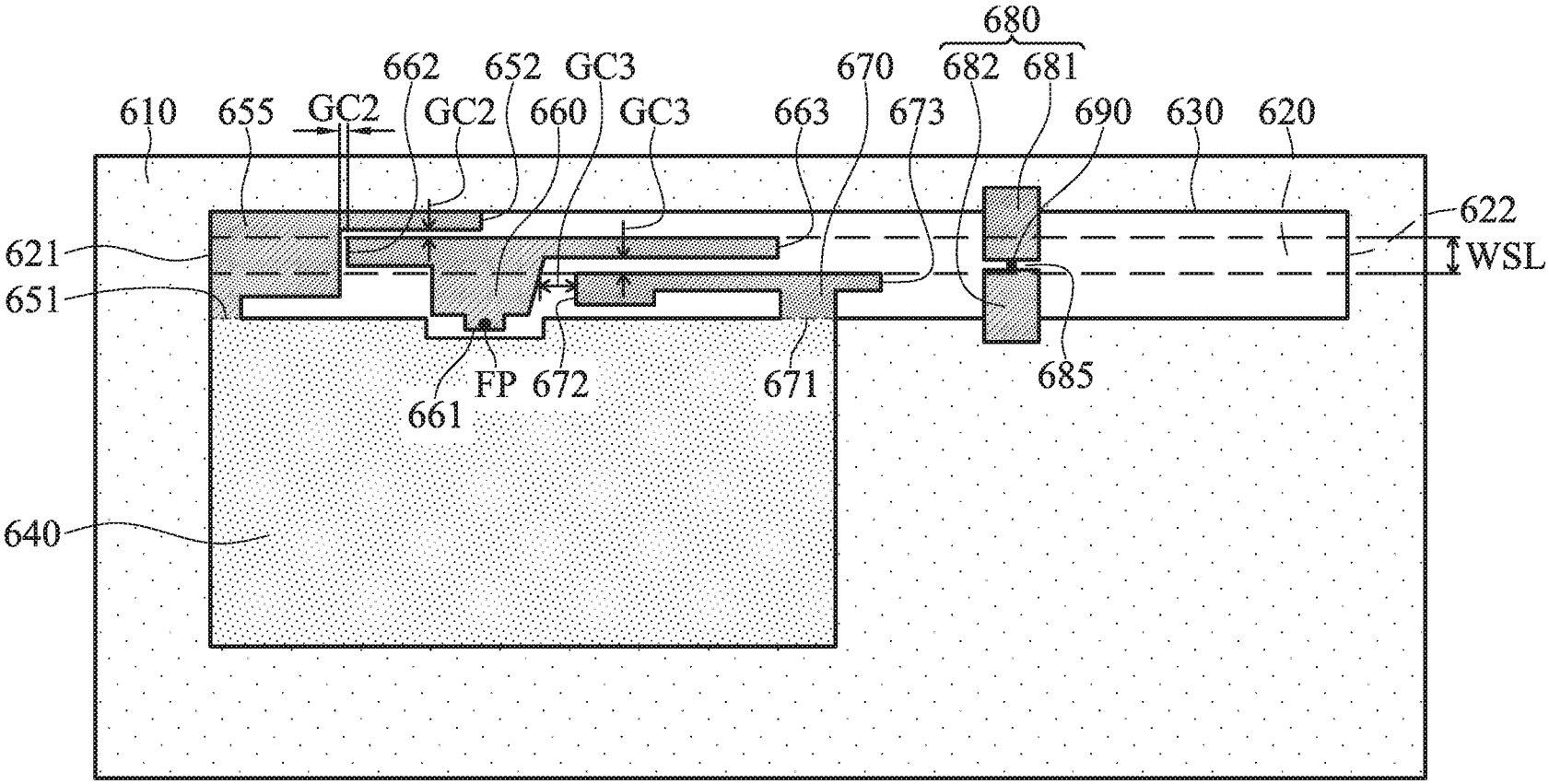
FIG. 6 is a top view of a mobile device according to an embodiment of the invention.

FIG. 6 is a top view of a mobile device 600 according to an embodiment of the invention. FIG. 6 is similar to FIG. 1A. In the embodiment of FIG. 6, the mobile device 600 includes a metal mechanism element 610, a dielectric substrate 630, a ground plane 640, a parasitic radiation element 650, a feeding radiation element 660, an additional radiation element 670, a tuning radiation element 680, and a circuit element 690. The ground plane 640, the parasitic radiation element 650, the feeding radiation element 660, the additional radiation element 670, and the tuning radiation element 680 may all be made of metal materials. The parasitic radiation element 650, the feeding radiation element 660, the additional radiation element 670, and the tuning radiation element 680 may all be disposed on a first surface of the dielectric substrate 630. A second surface of the dielectric substrate 630 may be adjacent to the metal mechanism element 610. The ground plane 640 may be coupled to the metal mechanism element 610, and the ground plane 640 may extend from the metal mechanism element 610 onto the first surface of the dielectric substrate 630. The metal mechanism element 610 has a slot 620. The slot 620 has a first closed end 621 and a second closed end 622. The parasitic radiation element 650 has a connection end 651 and an open end 652. The connection end 651 of the parasitic radiation element 650 is coupled to a first corner of the ground plane 640. The parasitic radiation element 650 includes a first widening portion 655. The first widening portion 655 is positioned at a bend in the parasitic radiation element 650. The parasitic radiation element 650 has a vertical projection on the metal mechanism element 610, and the vertical projection of the parasitic radiation element 650 at least partially overlaps the first closed end 621 of the slot 620.

The feeding radiation element 660 may substantially have a T-shape. The feeding radiation element 660 is disposed between the ground plane 640, the parasitic radiation element 650, and the additional radiation element 670. Specifically, the feeding radiation element 660 has a first end 661, a second end 662, and a third end 663. A feeding point FP is disposed at the first end 661 of the feeding radiation element 660. The second end 662 of the feeding radiation element 660 is an open end, which extends toward the first widening portion 655 of the parasitic radiation element 650. The third end 663 of the feeding radiation element 660 is another open end, which extends away from the second end 662 of the feeding radiation element 660. The additional radiation element 670 also may substantially have a T-shape. The additional radiation element 670 has a first end 671, a second end 672, and a third end 673. The first end 671 of the additional radiation element 670 is coupled to a second corner of the ground plane 640 (the second corner is opposite to the aforementioned first corner). The second end 672 of the additional radiation element 670 is an open end, which extends toward the feeding radiation element 660. The third end 673 of the additional radiation element 670 is another open end, which extends away from the second end 672 of the additional radiation element 670. In alternative embodiments, adjustments are made such that the additional radiation element 670 substantially has an L-shape, and the third end 673 of the additional radiation element 670 is omitted. Alternatively, the additional radiation element 670 may substantially have a rectangular shape or a trapezoidal shape. A second coupling gap GC2 is formed between the feeding radiation element 660 and the parasitic radiation element 650. A third coupling gap GC3 is formed between the feeding radiation element 660 and the additional radiation element 670.

The tuning radiation element 680 may substantially have a straight-line shape. The tuning radiation element 680 extends across the whole width WSL of the slot 620. Specifically, the tuning radiation element 680 includes a first portion 681 and a second portion 682, and a partition gap 685 is formed between the first portion 681 and the second portion 682. The first portion 681 and the second portion 682 of the tuning radiation element 680 are respectively coupled to the metal mechanism element 610. That is, each of the first portion 681 and the second portion 682 of the tuning radiation element 680 extends from the first surface of the dielectric substrate 630 onto the metal mechanism element 610. The circuit element 690 is coupled in series between the first portion 681 and the second portion 682 of the tuning radiation element 680. In some embodiments, the circuit element 690 is a capacitor or an inductor. For example, the aforementioned capacitor may be a fixed capacitor or a variable capacitor, and the aforementioned inductor may be a fixed inductor or a variable inductor. An antenna structure is formed by the parasitic radiation element 650, the feeding radiation element 660, the additional radiation element 670, the tuning radiation element 680, the circuit element 690, and the slot 620 of the metal mechanism element 610.

Figure 7:
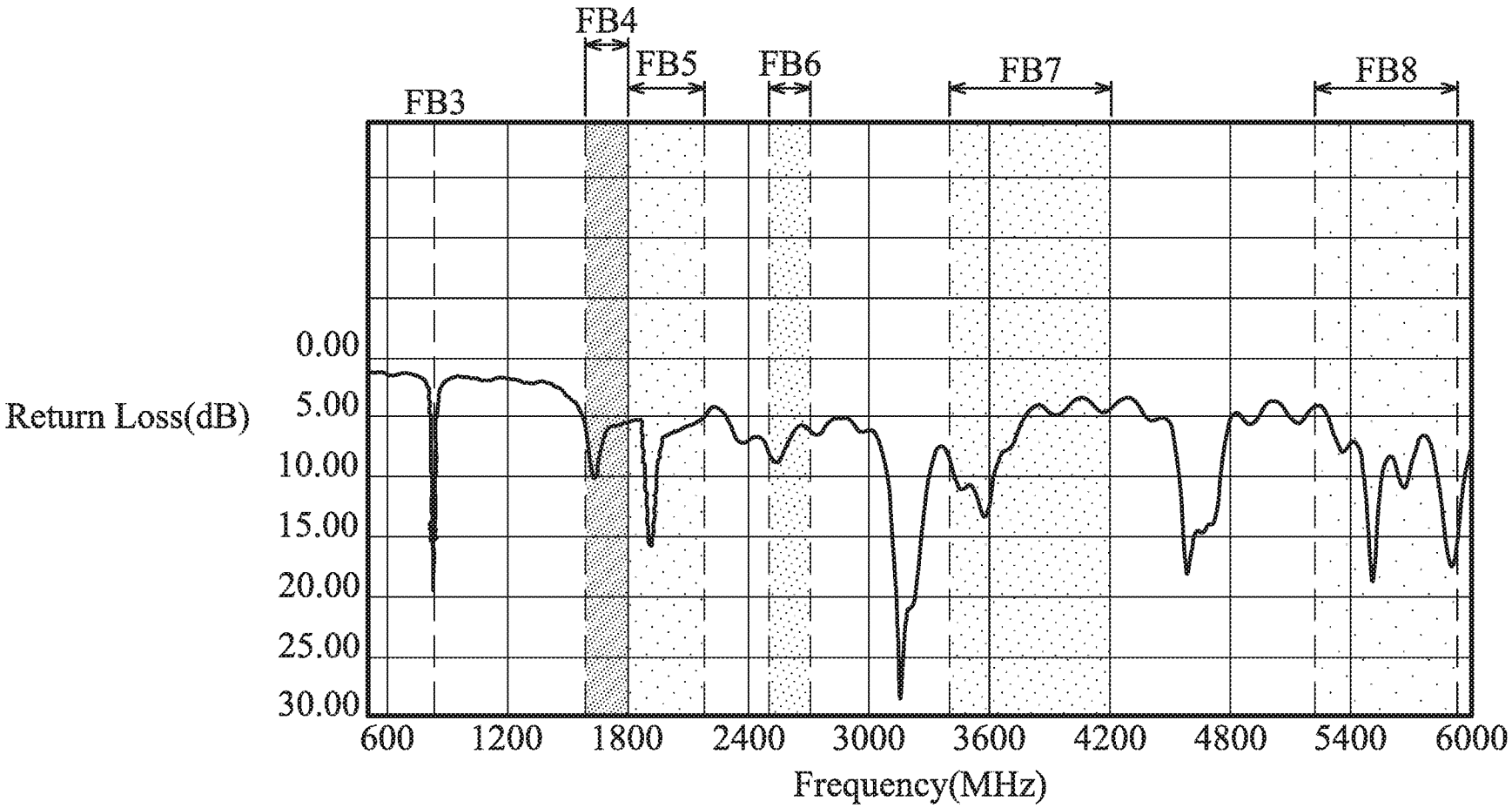
FIG. 7 is a diagram of return loss of an antenna structure of a mobile device according to an embodiment of the invention.

FIG. 7 is a diagram of return loss of the antenna structure of the mobile device 600 according to an embodiment of the invention. According to the measurement of FIG. 7, the antenna structure of the mobile device 600 can cover a third frequency band FB3, a fourth frequency band FB4, a fifth frequency band FBS, a sixth frequency band FB6, a seventh frequency band FB7, and an eighth frequency band FB8. The third frequency band FB3 may be at or around 824 MHz. The fourth frequency band FB4 may be from about 1575 MHz to about 1800 MHz. The fifth frequency band FB5 may be from about 1800 MHz to about 2170 MHz. The sixth frequency band FB6 may be from about 2500 MHz to about 2700 MHz. The seventh frequency band FB7 may be from about 3400 MHz to about 4200 MHz. The eighth frequency band FB8 may be from about 5150 MHz to about 5925 MHz. Accordingly, the mobile device 600 can support at least the wideband operations of LTE (Long Term Evolution). With respect to the antenna theory, the slot 620 of the metal mechanism element 610 is mainly excited to generate the third frequency band FB3. The feeding radiation element 660 and the slot 620 of the metal mechanism element 610 are mainly excited to generate the fourth frequency band FB4. The parasitic radiation element 650 is mainly excited to generate the fifth frequency band FB5. The additional radiation element 670 is mainly excited to generate the sixth frequency band FB6. Furthermore, higher-order resonant modes of the above frequency bands are further excited to generate the seventh frequency band FB7 and the eighth frequency band FB8. That is, by adding more radiation elements into the mobile device 600, its antenna structure can cover multiband operations, and is not limited to the aforementioned dual-band operations. The tuning radiation element 680 and the circuit element 690 are configured to fine-tune all of the operation frequency bands of the antenna structure of the mobile device 600. The circuit element 690 is configured to change the effective capacitance of the slot 620, thereby adjusting its resonant frequency bands. Specifically, according to practical measurements, the operation frequency band of the antenna structure may become lower if the capacitance of the circuit element 690 increases, and the operation frequency band of the antenna structure may become higher if the inductance of the circuit element 690 increases. In some embodiments, the circuit element 690 adjusts its variable capacitance or variable inductance according to a control signal from a processor (not shown), so as to increase the operation bandwidth of the antenna structure.

In some embodiments, the element sizes of the mobile device 600 are described as follows. The length of the slot 620 (i.e., the length from the first closed end 621 to the second closed end 622) may be substantially equal to 0.5 wavelength (λ/2) of the third frequency band FB3. The length of the parasitic radiation element 650 (i.e., the length from the connection end 651 to the open end 652) may be longer than or equal to 0.25 wavelength (λ/4) of the fifth frequency band FBS. The length of the additional radiation element 670 (i.e., the length from the first end 671 to the second end 672) be substantially equal to 0.25 wavelength (λ/4) of the sixth frequency band FB6. The width of the second coupling gap GC2 may be from 0.5 mm to 5 mm. In some embodiments, the second coupling gaps GC2 of FIG. 6 have different widths. The width of the third coupling gap GC3 may be from 0.5 mm to 5 mm. The above ranges of element sizes are calculated and obtained according to the results of many experiments, and they help to optimize the operation bandwidth and impedance matching of the antenna structure of the mobile device 600. Other features of the mobile device 600 of FIG. 6 are similar to those of the mobile device 100 of FIG. 1A and FIG. 1B. Accordingly, the two embodiments can achieve similar levels of performance.

Figure 8:
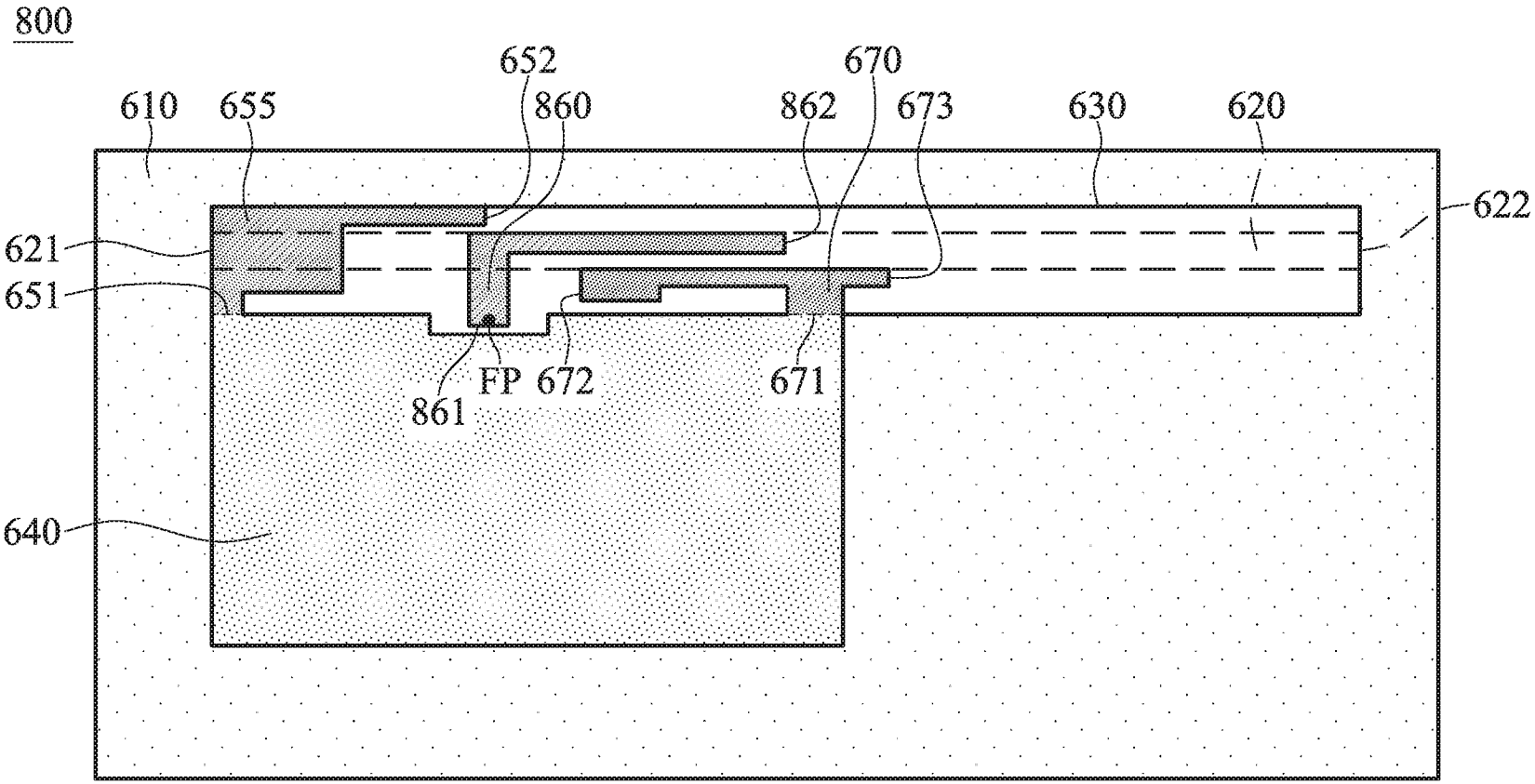
FIG. 8 is a top view of a mobile device according to an embodiment of the invention.

FIG. 8 is a top view of a mobile device 800 according to an embodiment of the invention. FIG. 8 is similar to FIG. 6. In the embodiment of FIG. 8, adjustments are made such that a feeding radiation element 860 of the mobile device 800 substantially has an equal-width L-shape, and the mobile device 800 includes neither the aforementioned tuning radiation element 680 nor the aforementioned circuit element 690. The feeding radiation element 860 has a first end 861 and a second end 862. The feeding point FP is positioned at the first end 861 of the feeding radiation element 860. The second end 862 of the feeding radiation element 860 is an open end, which extends away from the parasitic radiation element 650. According to practical measurements, the mobile device 800 without a portion of radiation elements can still cover multiband operations. Other features of the mobile device 800 of FIG. 8 are similar to those of the mobile device 600 of FIG. 6. Accordingly, the two embodiments can achieve similar levels of performance. It should be understood that the mobile device 600 of FIG. 6 and the mobile device 800 of FIG. 8 are considered as wideband modified versions of the mobile device 100 of FIG. 1A and FIG. 1B.

The invention proposes a novel mobile device and a novel antenna structure, which are integrated with a metal mechanism element. The metal mechanism element does not negatively affect the radiation performance of the antenna structure because the metal mechanism element is considered as an extension portion of the antenna structure. In comparison to the conventional design, the invention has at least the advantages of small size, wide bandwidth, and beautiful device appearance, and therefore it is suitable for application in a variety of mobile communication devices.

Note that the above element sizes, element shapes, and frequency ranges are not limitations of the invention. An antenna designer can fine-tune these settings or values according to different requirements. It should be understood that the mobile device and antenna structure of the invention are not limited to the configurations of FIGS. 1-8. The invention may merely include any one or more features of any one or more embodiments of FIGS. 1-8. In other words, not all of the features displayed in the figures should be implemented in the mobile device and antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A mobile device, comprising:

a metal mechanism element, having a slot, wherein the slot has a first closed end and a second closed end;

a ground plane;

a parasitic radiation element, having a connection end and an open end, wherein the connection end of the parasitic radiation element is coupled to the ground plane, the parasitic radiation element comprises a first widening portion, the first widening portion is positioned at a bend of the parasitic radiation element, the parasitic radiation element has a vertical projection on the metal mechanism element, and the vertical projection of the parasitic radiation element at least partially overlaps the first closed end of the slot;

a feeding radiation element, having a feeding point, wherein the feeding radiation element is disposed between the parasitic radiation element and the ground plane; and a dielectric substrate, disposed adjacent to the metal mechanism element, wherein the parasitic radiation element and the feeding radiation element are disposed on the dielectric substrate;

wherein an antenna structure is formed by the parasitic radiation element, the feeding radiation element, and the slot of the metal mechanism element.

2. The mobile device as claimed in claim 1, wherein the slot substantially has a straight-line shape.

3. The mobile device as claimed in claim 1, wherein the parasitic radiation element substantially has a width-varying L-shape.

4. The mobile device as claimed in claim 1, wherein the first widening portion of the parasitic radiation element substantially has a rectangular shape or a triangular shape.

5. The mobile device as claimed in claim 1, wherein the parasitic radiation element further comprises a second widening portion and a connection portion, the second widening portion is positioned at the open end of the parasitic radiation element, and the connection portion is coupled between the first widening portion and the second widening portion.

6. The mobile device as claimed in claim 5, wherein the second widening portion of the parasitic radiation element substantially has a rectangular shape.

7. The mobile device as claimed in claim 5, wherein the ground plane further comprises a protruding portion, and the protruding portion extends toward the second widening portion of the parasitic radiation element.

8. The mobile device as claimed in claim 7, wherein the protruding portion of the ground plane substantially has a rectangular shape, an L-shape, or a trapezoidal shape.

9. The mobile device as claimed in claim 1, wherein the feeding radiation element substantially has a rectangular shape, an L-shape, or a trapezoidal shape.

10. The mobile device as claimed in claim 1, wherein the feeding radiation element has a vertical projection on the metal mechanism element, and the vertical projection of the feeding radiation element at least partially overlaps the slot.

11. The mobile device as claimed in claim 1, further comprising:

a thickening layer, disposed between the dielectric substrate and the metal mechanism element.

12. The mobile device as claimed in claim 1, wherein the antenna structure covers a first frequency band and a second frequency band, the first frequency band is from 2400 MHz to 2500 MHz, and the second frequency band is from 5150 MHz to 5850 MHz.

13. The mobile device as claimed in claim 12, wherein a length of the slot is equal to 0.5 wavelength of the first frequency band.

14. The mobile device as claimed in claim 12, wherein a length of the parasitic radiation element is longer than or equal to 0.25 wavelength of the first frequency band.

15. The mobile device as claimed in claim 1, further comprising:

an additional radiation element, coupled to the ground plane, wherein the feeding radiation element is positioned between the parasitic radiation element and the additional radiation element.

16. The mobile device as claimed in claim 15, wherein the additional radiation element substantially has a T-shape, a rectangular shape, a trapezoidal shape, or an L-shape.

17. The mobile device as claimed in claim 15, further comprising:

a tuning radiation element, extending across the slot, wherein the tuning radiation element comprises a first portion and a second portion, and the first portion and the second portion are respectively coupled to the metal mechanism element; and a circuit element, coupled between the first portion and the second portion of the tuning radiation element.

18. The mobile device as claimed in claim 17, wherein the circuit element is a capacitor or an inductor.

19. The mobile device as claimed in claim 17, wherein the antenna structure covers a third frequency band, a fourth frequency band, a fifth frequency band, a sixth frequency band, a seventh frequency band, and an eighth frequency band, the third frequency band is at 824 MHz, the fourth frequency band is from 1575 MHz to 1800 MHz, the fifth frequency band is from 1800 MHz to 2170 MHz, the sixth frequency band is from 2500 MHz to 2700 MHz, the seventh frequency band is from 3400MHz to 4200MHz, and the eighth frequency band is from 5150 MHz to 5925 MHz.

* * * * *